US008485100B2

(12) United States Patent
Lee

(10) Patent No.: US 8,485,100 B2
(45) Date of Patent: Jul. 16, 2013

(54) AMMUNITION

(75) Inventor: Se-Chan Lee, Seoul (KR)

(73) Assignee: Korea Nuclear Engineering Co., Ltd., Gyeonggi-do (KR)

( * ) Notice: Subject to any disclaimer, the term of this patent is extended or adjusted under 35 U.S.C. 154(b) by 351 days.

(21) Appl. No.: 12/921,872

(22) PCT Filed: Feb. 27, 2009

(86) PCT No.: PCT/KR2009/000950

§ 371 (c)(1),
(2), (4) Date: Oct. 20, 2010

(87) PCT Pub. No.: WO2009/113773

PCT Pub. Date: Sep. 17, 2009

(65) Prior Publication Data

US 2011/0030571 A1 Feb. 10, 2011

(30) Foreign Application Priority Data

Mar. 13, 2008 (KR) ..... 10-2008-0023385

(51) Int. Cl.
*F42B 10/00* (2006.01)
*F42B 14/00* (2006.01)

(52) U.S. Cl.
USPC ..... 102/430; 102/520; 102/521; 102/522

(58) Field of Classification Search
USPC ..... 102/520, 521, 522, 430
See application file for complete search history.

(56) References Cited

U.S. PATENT DOCUMENTS

| | | | | |
|---|---|---|---|---|
| 3,672,301 | A * | 6/1972 | Abbott | 102/530 |
| 4,708,063 | A | 11/1987 | Ladriere | |
| 4,977,834 | A * | 12/1990 | Denis | 102/439 |
| 6,657,174 | B1 | 12/2003 | Olsson | |
| 7,096,791 | B2 | 8/2006 | Vanmoor | |
| 7,415,929 | B1 * | 8/2008 | Faughn | 102/457 |
| 8,037,830 | B2 * | 10/2011 | Winter | 102/470 |

FOREIGN PATENT DOCUMENTS

JP 10-300399 A 2/2002

* cited by examiner

*Primary Examiner* — J. Woodrow Eldred
(74) *Attorney, Agent, or Firm* — Patent Law Group LLP

(57) ABSTRACT

Provided is ammunition capable of increasing the movement velocity and shooting range of a bullet and enhancing the target hitting rate. The ammunition includes a case having a propellant chamber and a front mouth, a propellant charged into the propellant chamber of the case, a primer installed in the case for exploding the propellant when a physical or electrical impact is applied thereto, a bullet arranged in the front mouth of the case, the bullet having a streamlined tail portion for reduction of air resistance when the bullet is shot, and a wad fitted to the front mouth of the case for removably holding the bullet and closing the front mouth, the wad being separable from the bullet during explosion of the propellant.

3 Claims, 3 Drawing Sheets

AMMUNITION

FIELD OF THE INVENTION

The present invention relates to an ammunition for firearms or cannons and, more particularly, to an ammunition capable of increasing the movement velocity and shooting range of a bullet while enhancing the hitting rate thereof.

BACKGROUND ART

In general, as shown in FIG. 1, an ammunition includes a case 1 with a front mouth and a rear base, a bullet 3 fitted to the front mouth of the case 1, a propellant 5 charged into the case 1 and a primer 7 installed in the rear base of the case 1.

In this ammunition, if a percussion lock applies an impact to the primer 7, the propellant 5 is exploded by the application of impact. At this moment, the bullet 3 is pushed forwards by the explosive power of the propellant 5. As a result, the bullet 3 is shot forwards with a high propelling force. The bullet 3 thus shot flies far away and reaches a target point.

With this conventional ammunition, the bullet 3 is configured to have a planar rear portion so that it can receive the explosive power of the propellant 5 as much as possible. This poses a drawback in that, when the bullet 3 is shot into the air, an eddy air flow is generated in the planar rear portion of the bullet 3. This imparts increased air resistance to the bullet 3, consequently reducing the movement velocity of the bullet 3 and shortening the shooting range thereof.

Due to the eddy air flow generated in the planar rear portion of the bullet 3, the conventional ammunition suffers from reduction in the straight-ahead movement ability of the bullet 3. This leads to a problem in that the deviation between an aiming point and a hitting point becomes greater, thus reducing the target hitting rate of the bullet 3.

DETAILED DESCRIPTION OF THE PREFERRED EMBODIMENTS

Technical Problems

In view of the above-noted problems inherent in the prior art, it is an object of the present invention to provide ammunition capable of preventing occurrence of an eddy air flow in the rear portion of a bullet and eventually reducing the air resistance against the bullet.

Another object of the present invention is to provide ammunition capable of increasing the movement velocity and shooting range of a bullet by reducing the air resistance against the bullet.

A further object of the present invention is to provide ammunition capable of improving the straight-ahead movement ability of a bullet and enhancing the target hitting rate thereof by preventing occurrence of an eddy air flow in the rear portion of the bullet.

Solution to the Technical Problems

With these objects in view, there is provided an ammunition including: a case having a propellant chamber and a front mouth; a propellant charged into the propellant chamber of the case; a primer installed in the case for exploding the propellant when a physical or electrical impact is applied thereto; a bullet arranged in the front mouth of the case, the bullet having a streamlined tail portion for reduction of air resistance when the bullet is shot; and a wad fitted to the front mouth of the case for removably holding the bullet and closing the front mouth, the wad being separable from the bullet during explosion of the propellant.

Preferably, the wad may include a body portion removably fitted to the front mouth of the case, a bullet socket portion formed inside the body portion so that the tail portion of the bullet can be fitted to the bullet socket portion and a fixing means for removably fixing the tail portion of the bullet to the bullet socket portion.

Advantageous Effects

With the ammunition in accordance with the present invention, the rear portion of a bullet is formed into a streamline shape. This minimizes frictional resistance of the ambient air against the bullet at the shooting time, thereby preventing occurrence of an eddy air flow in the rear portion of the bullet.

The minimized frictional resistance of the ambient air and the prevention of occurrence of an eddy air flow help maximize the movement velocity of a bullet and increase the shooting range thereof. In particular, the prevention of occurrence of an eddy air flow in the rear portion of the bullet assists in improving the straight-ahead movement ability of the bullet and consequently reducing the deviation between an aiming point and a hitting point, which is effective in increasing the target hitting rate.

Best Mode for Carrying Out the Invention

Hereinafter, one preferred embodiment of ammunition in accordance with the present invention will be described in detail with reference to the accompanying drawings.

Figure 3:
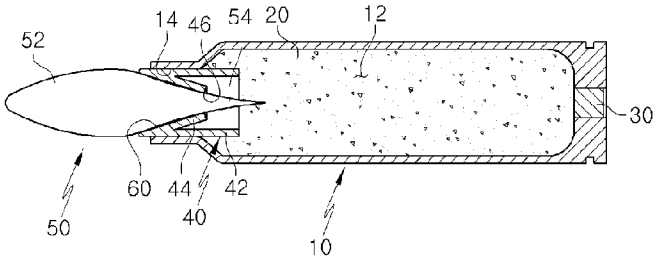
FIG. 3 is a side section view of the ammunition shown in FIG. 2 but kept in an assembled state.
Figure 2:
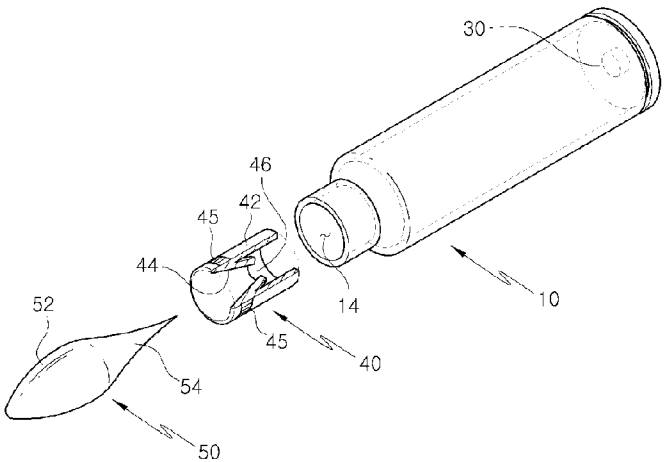
FIG. 2 is an exploded perspective view showing ammunition in accordance with the present invention.

FIG. 2 is an exploded perspective view showing ammunition in accordance with the present invention. FIG. 3 is a side section view of the ammunition shown in FIG. 2 but kept in an assembled state.

Referring first to FIGS. 2 and 3, the present ammunition includes a case 10 with a front mouth 14 and a rear base. The case 10 has a propellant chamber 12 opened at its front end and charged with a propellant 20 or gunpowder. The propellant 20 can be exploded when an impact is applied thereto.

A primer 30 is installed in the rear base of the case 10. The primer 30 is detonated upon receiving a physical or electrical impact applied by a percussion lock of firearms or cannons. The detonating power is transferred to the propellant 20 so that the propellant 20 can be exploded within the case 10.

Referring again to FIGS. 2 and 3, the present ammunition includes a wad 40 for closing the front mouth 14 of the case 10. The wad 40 includes a body portion 42 and a bullet socket portion 44 formed inside the body portion 42. The body portion 42 is formed into a cylindrical shape and removably fixed to the front mouth 14 of the case 10. In other words, the body portion 42 closes up the front mouth 14 to hermetically seal the propellant chamber 12.

In this regard, the body portion 42 is press-fitted and fixedly secured to the front mouth 14 of the case 10 so that it can be separated from the case 10 when the propellant 20 is exploded. The front mouth 14 may be crushed radially inwardly to increase the coupling force of the body portion 42 relative to the front mouth 14.

The bullet socket portion 44 is used to hold a bullet 50 in place and has a shape corresponding to the external surface shape of the bullet 50. In this connection, the rear portion of the bullet 50 is fitted to and held by the bullet socket portion 44. Thus, the shape of the bullet socket portion 44 corresponds to the shape of the rear portion of the bullet 50.

Since the wad 40 is fitted so as to close the front mouth 14 of the propellant chamber 12, the explosion pressure of the propellant 20 is concentrated to the wad 20. When the propellant 20 is exploded, therefore, the wad 40 is propelled forwards from the front mouth 14, thereby imparting a propelling force to the bullet 50 held in the bullet socket portion 44.

In addition, the wad 40 is fixed to the front mouth 14 of the case 10 while holding the bullet 50 thereon. Thus, the wad 40 serves to fix the bullet 50 to the case 10.

Tooth-like protrusions 45 are formed on the outer circumferential surface of the wad 40 along the circumferential direction thereof. The protrusions 45 make frictional contact with the rifling of a barrel during forward propulsion of the wad 40 and serve to increase the rotational force of the wad 40 and the bullet 50 held thereon.

Referring again to FIGS. 2 and 3, the bullet 50 is fixed to the bullet socket portion 44 of the wad 40. The bullet 50 includes a conical head portion 52 of obtuse shape and a thin tail portion 54 of acute shape.

The tail portion 54 is supported on the bullet socket portion 44 of the wad 40 and has a streamline shape gradually thinning toward the tip end thereof. The streamlined tail portion 54 helps minimize the frictional resistance of the air against the bullet 50. Furthermore, the streamlined tail portion 54 ensures that the ambient air flows regularly in a laminar pattern when the bullet 50 is shot through the air. This prevents occurrence of an eddy air flow in the rear portion of the bullet 50.

The bullet 50 supported on the wad 40 is shot together with the wad 40 at the time of explosion of the propellant 20, thus flying to a target point. Provision of the streamlined tail portion 54 in the bullet 50 minimizes the frictional resistance of the air against the bullet 50 and prevents occurrence of an eddy air flow in the rear portion of the bullet 50. This maximizes the movement velocity and shooting range of the bullet 50. In addition, the prevention of occurrence of an eddy air flow in the rear portion of the bullet 50 assists in improving the straight-ahead movement ability of the bullet 50 and consequently reducing the deviation between an aiming point and a hitting point, which greatly increases the target hitting rate.

The bullet socket portion 44 of the wad 40 has a streamline shape corresponding to the shape of the tail portion 54 of the bullet 50. The bullet socket portion 44 has a through-hole 46 that allows the tip end of the tail portion 54 to pass therethrough. Formation of the through-hole 46 ensures that the bullet socket portion 44 can efficiently support the tail portion 54 of the bullet 50, while allowing the tail portion 54 to be efficiently separated from the bullet socket portion 44. If necessary, the through-hole 46 may not be formed in the bullet socket portion 44.

Referring again to FIGS. 2 and 3, the present ammunition includes a fixing means for removably fixing the bullet 50 to the bullet socket portion 44 of the wad 40. In the illustrated embodiment, the fixing means is composed of a paraffin adhesive 60 for bonding the tail portion 54 of the bullet 50 and the bullet socket portion 44 of the wad 40 together. The paraffin adhesive 60 is kept in a solid state at a normal temperature to bond the tail portion 54 and the bullet socket portion 44 together. At an elevated temperature, the paraffin adhesive 60 is melted into a liquid state, allowing the tail portion 54 and the bullet socket portion 44 to be separated from each other. In other words, the paraffin adhesive 60 normally keeps the bullet 50 bonded to the bullet socket portion 44 of the wad 40. When the bullet 50 is shot, the paraffin adhesive 60 is melted by the heat generated during explosion of the propellant 20, allowing the bullet 50 to be separated from the wad 40.

Since the fixing means normally keeps the bullet 50 bonded to the wad 40, the bullet 50, the wad 40 and the case 10 are interconnected to form a single body. When shot, the bullet 50 is separated from the wad 40 and moved toward a target point.

Figure 4:
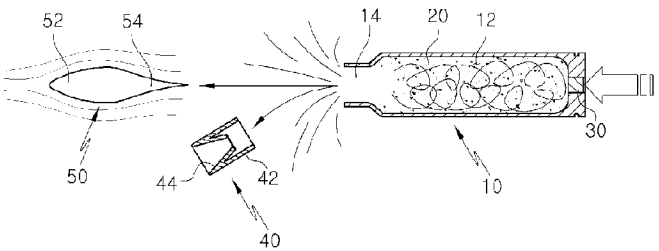
FIG. 4 is a view illustrating an operation example of the present ammunition.
Figure 1:
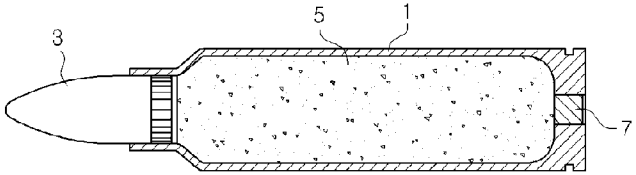
Fig. 1 (Prior Art)
FIG. 1 is a section view illustrating the configuration of conventional ammunition.

Next, an operation example of the present ammunition configured as above will be described with reference to FIGS. 3 and 4.

The present ammunition is first loaded to a firearm or a gun (not shown) and then a percussion lock is actuated. Upon actuating the percussion lock, a physical or electrical impact is applied to the primer 30. In response, the primer 30 is detonated to explode the propellant 20 charged in the propellant chamber 12.

At this time, the propellant 20 thus exploded generates a combustion gas of high pressure and combustion heat, which in turn act against the rear end of the wad 40 fitted to the front mouth 14. Thus, the wad 40 and the bullet 50 are shot forwards with a high propelling force.

The combustion heat of the propellant 20 acting against the wad 40 is transferred to the paraffin adhesive 60 present between the bullet 50 and the wad 40. As a result, the paraffin adhesive 60 is melted so that the bullet 50 and the wad 40 can be separated from each other. Thereafter, the bullet 50 alone is moved forwards with a high propelling force.

With the ammunition of the present invention configured as above, it is possible to minimize the frictional resistance of the air against the bullet 50 and to prevent occurrence of an eddy air flow. This is because the tail portion 54 of the bullet 50 is formed into a streamline shape. The minimization of the frictional resistance and the prevention of occurrence of an eddy air flow help maximize the movement velocity and shooting range of the bullet 50. In particular, the prevention of occurrence of an eddy air flow in the rear portion of the bullet 50 assists in improving the straight-ahead movement ability of the bullet 50 and consequently reducing the deviation between an aiming point and a hitting point, which leads to an increase in the target hitting rate.

Referring next to FIGS. 5 through 9, there are shown different modified examples of the present ammunition and the bullet.

Figure 5:
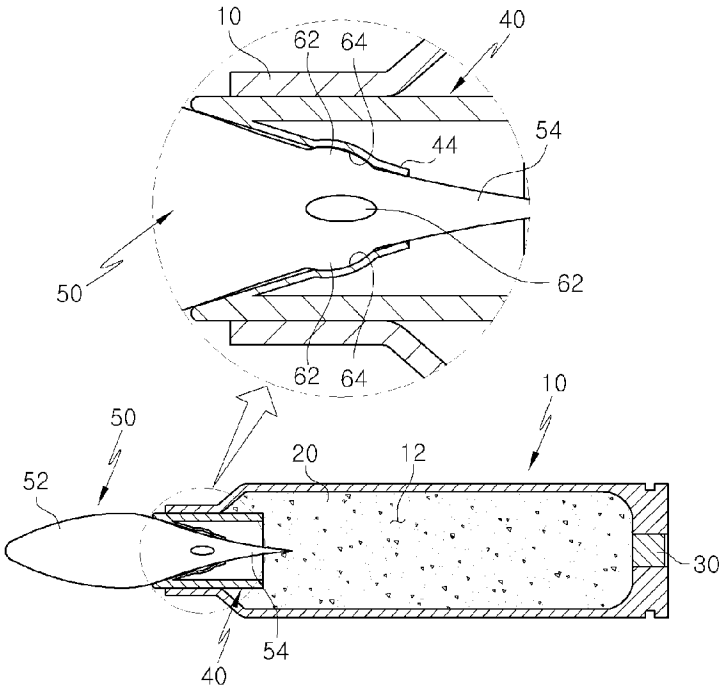
FIG. 5 is a section view showing modified examples of a bullet and a bullet holding wad employed in the present ammunition.

In the modified example shown in FIG. 5, the fixing means for removably fixing the bullet 50 to the bullet socket portion 44 of the wad 40 includes protrusions 62 and grooves 64. The protrusions 62 are formed at an equal interval along the outer circumferential surface of the tail portion 54 of the bullet 50. The grooves 64 are formed on the inner circumferential surface of the bullet socket portion 44 so as to engage with the protrusions 62.

The protrusions 62 and the grooves 64 are kept engaged with each other at normal times so that the bullet 50 can be fixed to the bullet socket portion 44. When the bullet 50 is shot, the protrusions 62 are disengaged from the grooves 64 by the explosion of the propellant 20, allowing the bullet 50 to be separated from the wad 40.

Although the protrusions 62 are formed in the bullet 50 with the grooves 64 formed in the wad 40 according to the illustrated embodiment, it may be possible to form the protrusions 62 in the wad 40 and the grooves 64 in the bullet 50, if appropriate.

Figure 6:
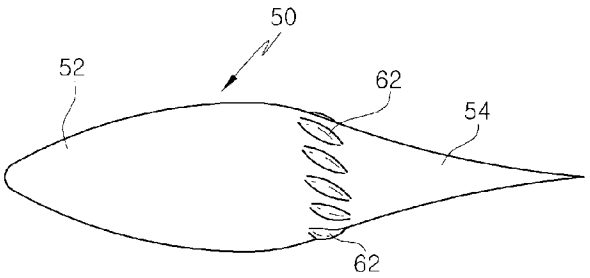
FIGS. 6 through 9 show different modified examples of the ammunition and the bullet.

In case where the protrusions 62 are formed in the bullet 50, it is preferred that they are inclined at a specified angle with respect to the circumferential direction of the bullet 50 as illustrated in FIG. 6. More preferably, the protrusions 62 are inclined so as to extend in the same direction as the rifling of a barrel. This is to reduce the air resistance and to rotate the bullet 50 when the latter flies through the air. Needless to say, the grooves 64 engaging with the protrusions 62 are also inclined at an angle corresponding to that of the protrusions 62.

Figure 7:
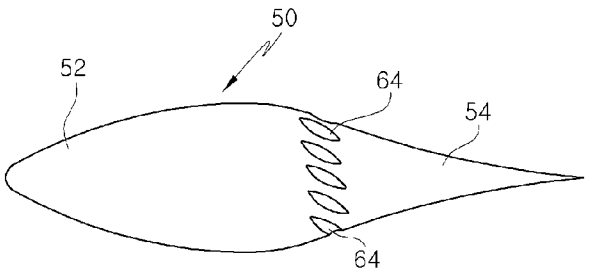

In case where the grooves 64 are formed in the bullet 50 as illustrated in FIG. 7, it is preferable that they are inclined at a specified angle with respect to the circumferential direction of the bullet 50. More preferably, the grooves 64 are inclined so as to extend in the same direction as the rifling of a barrel. This is to reduce the air resistance and to rotate the bullet 50 when the latter flies through the air. Needless to say, the protrusions 62 engaging with the grooves 64 are also inclined at an angle corresponding to that of the grooves 64.

Figure 8:
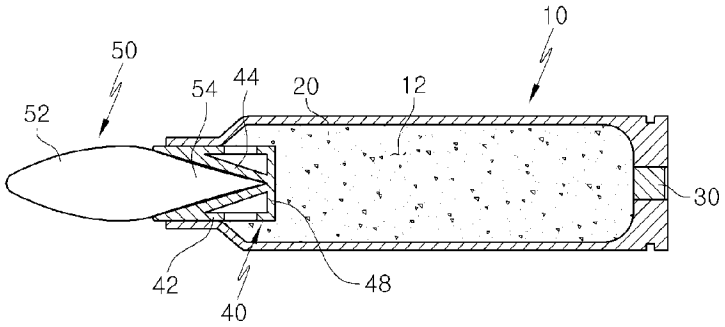

In the modified example shown in FIG. 8, the ammunition includes a wad 40 having a closed rear portion 48 of planar shape. During explosion of the propellant 20, the rear portion 48 of planar shape can receive an increased explosion pressure. This makes it possible to impart an increased propelling force to the wad 40 and the bullet 50 supported thereon.

Figure 9:
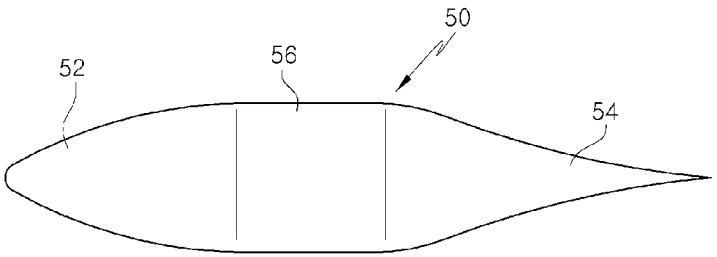

In the modified example shown in FIG. 9, the ammunition includes a bullet 50 having a head portion 52, a tail portion 54 and an intermediate body portion 56 for interconnecting the head portion 52 and the tail portion 54. The intermediate body portion 56 is formed to have a constant cross-sectional area, i.e., a constant diameter, along the longitudinal direction thereof. Therefore, the intermediate body portion 56 has a rectilinear shape when seen in a side view. Provision of the intermediate body portion 56 in this modified example helps increase the overall length of the bullet 50, which makes it possible to stably shoot the bullet 50.

While one preferred embodiment and certain modified examples of the invention have been described hereinabove, the present invention is not limited thereto. It is to be understood that various changes and modifications may be made without departing from the scope of the invention defined in the claims.

Industrial Applicability

The ammunition of the present invention can find its application in the ammunition production field.

The invention claimed is:

1. An ammunition comprising:

a case (10) having a propellant chamber (12) and a front mouth (14);

a propellant (20) charged into the propellant chamber (12) of the case (10);

a primer (30) installed in the case (10) for exploding the propellant (20) when a physical or electric al impact is applied thereto;

a bullet (50) arranged in the front mouth (14) of the case (10), the bullet (50) having a streamlined tail portion (54) of conical shape with a pointed end for reduction of air resistance when the bullet (50) is shot, and the pointed end of the tail portion (54) being inserted into the propellant (20); and a wad (40) fitted to the front mouth (14) of the case (10) for removably holding the bullet (50) and closing the front mouth (14), the wad (40) being separable from the bullet (50) during explosion of the propellant (20), and wherein the wad (40) includes a body portion (42) removably fitted to the front mouth (14) of the case (10), a bullet socket portion (44) formed inside the body portion (42) so that the tail portion (54) of the bullet (50) can be fitted to the bullet socket portion (44) and a fixing means for removably fixing the tail portion (54) of the bullet (50) to the bullet socket portion (44), and wherein the bullet socket portion (44) of the wad (40) takes the form of truncated cone and has a through-hole (46) that allows the tail portion (54) of the bullet (50) to pass therethrough, and wherein the wad (40) has tooth-shaped protrusions (45) formed along a circumferential direction of the wad (40) so that the protrusions (45) can make frictional contact with a rifling of a barrel to increase the rotational force of the wad (40) and the bullet (50), and wherein the fixing means includes a paraffin adhesive (60) for bonding the tail portion (54) of the bullet (50) and the bullet socket portion (44) of the wad (40) together, the paraffin adhesive (60) being melted by the heat generated during explosion of the propellant (20) to allow the bullet (50) to be separated from the wad (40).

2. The ammunition as recited in claim 1, wherein the fixing means includes protrusions (62) formed in one of the bullet (50) and the bullet socket portion (44) of the wad (40) and grooves (64) formed in the other to engage with the protrusions (62), and wherein the protrusions (62) and the grooves (64) are disengaged from each other by an explosion impact of the propellant (20) to allow the bullet (50) to be separated from the wad (40).

3. The ammunition as recited in claim 2, wherein the protrusions (62) and the grooves (64) are inclined to extend in the same direction as the rifling of the barrel.

* * * * *